United States Patent [19]

Wood

[11] Patent Number: 4,853,160

[45] Date of Patent: Aug. 1, 1989

[54] APPARATUS FOR ADJUSTING A VARIABLE LENGTH VALVE MEMBER FOR A NEEDLE VALVE

[75] Inventor: LeRoy T. Wood, Racine, Wis.

[73] Assignee: Outboard Marine Corporation, Waukegan, Ill.

[21] Appl. No.: 262,730

[22] Filed: Oct. 26, 1988

[51] Int. Cl.[4] ..... F02M 3/08

[52] U.S. Cl. ..... 261/41.5; 261/71; 137/903; 251/79; 251/81; 251/122

[58] Field of Search ..... 261/DIG. 38, 41.5, 66, 261/71; 137/903; 251/122, 79, 81

[56] References Cited

U.S. PATENT DOCUMENTS

| | | | |
|---|---|---|---|
| 622,912 | 4/1899 | Corey, Jr. | 251/81 |
| 3,414,244 | 12/1968 | Patterson, Jr. | 261/DIG. 38 |
| 3,622,118 | 11/1971 | Schadler | 251/81 |
| 3,635,254 | 1/1972 | Mitchell | 261/DIG. 38 |
| 3,719,322 | 3/1973 | Gifford | 261/DIG. 38 |
| 4,496,497 | 1/1985 | Satoh | 261/41.5 |
| 4,568,499 | 2/1986 | Wood | 261/41 |

*Primary Examiner*—Tim Miles

*Attorney, Agent, or Firm*—Michael, Best & Friedrich

[57] ABSTRACT

A carburetor including a valve apparatus comprising a wall defining a chamber having an axis and having therein an inlet communicating with the chamber and an outlet communicable with the chamber and having a valve seat, a valve member having two opposite ends and a variable length in the direction of the axis which decreases only when at least a predetermined force is applied to the valve member in the direction of the axis, the wall supporting the valve member and being threaded so as to allow movement of the valve member along the axis and into and out of sealing engagement with the valve seat, the wall having a step extending into the chamber and engageable with the valve member, the step limiting the movement of one end of the valve member towards the valve seat.

13 Claims, 2 Drawing Sheets

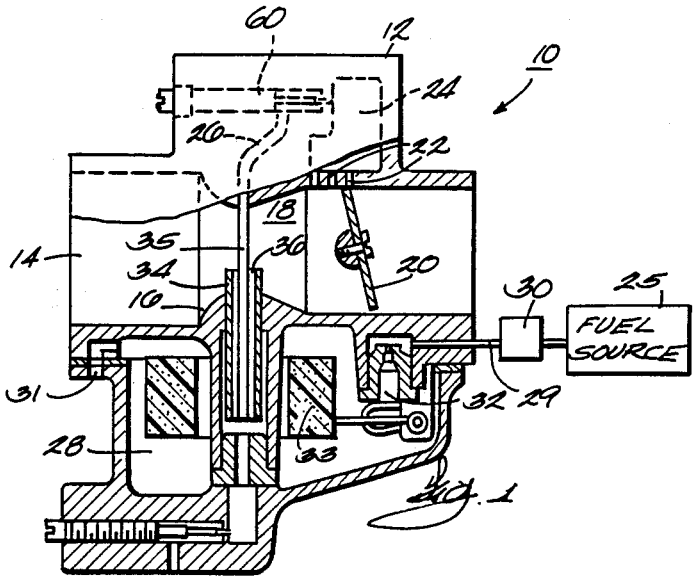
Fig. 1
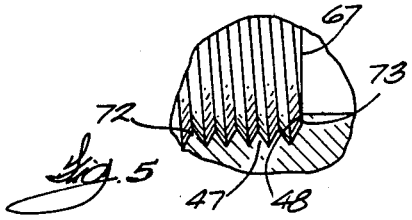
Fig. 5
Fig. 2
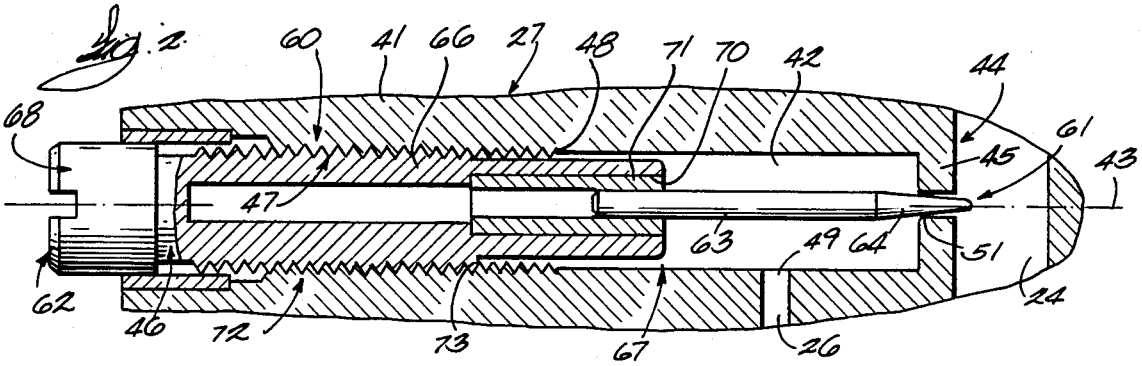
Fig. 3
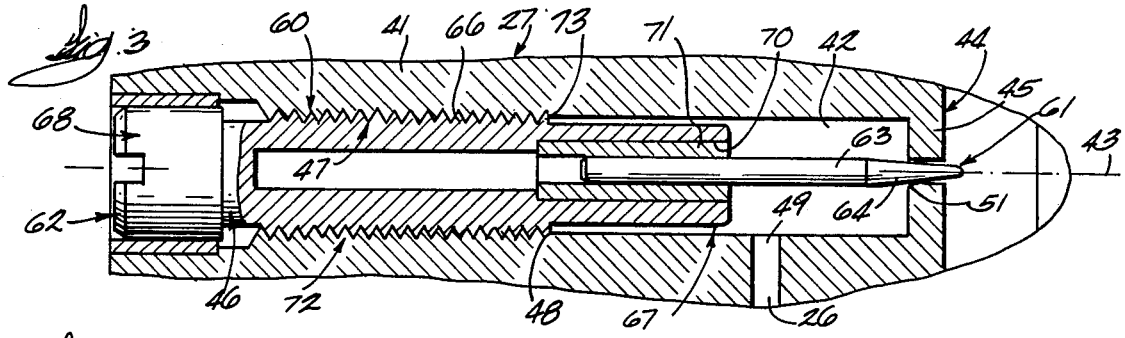
Fig. 4
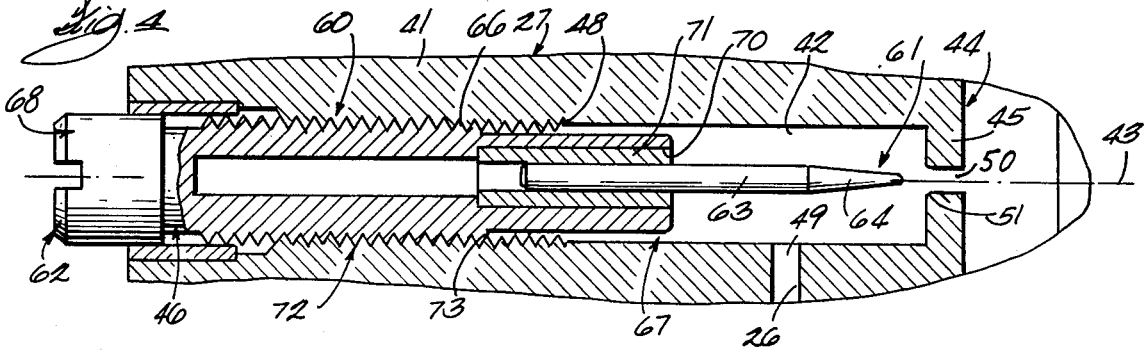

APPARATUS FOR ADJUSTING A VARIABLE LENGTH VALVE MEMBER FOR A NEEDLE VALVE

BACKGROUND OF THE INVENTION

The invention relates to needle valves and more particularly to needle valves for adjusting carburetors.

The use of plastic in making carburetor needle valves is known. A problem encountered with the use of plastic materials in such an application includes the tendency of plastics to creep under application of heat, thereby reducing the precision of the tolerances to which the plastic elements are manufactured. Another problem with the use of plastic materials in a carburetor needle valve arises in the use of a metal valve member in conjunction with a plastic valve seat. During calibration of the carburetor, the metal needle valve member often engage the plastic valve seat under excessive pressure, thereby damaging the needle as well as the seat. This damage results in waste of damaged valve seats and needles. In addition, the cost of manufacturing highly precise, machined parts is increased by the prospect of waste due to damage.

Attention is directed to U.S. Pat. No. 4,568,499 which, issued to Wood on Feb. 4, 1986 and which is assigned to the assignee hereof.

SUMMARY OF THE INVENTION

The invention provides a carburetor comprising a fuel/air induction passage, a secondary orifice communicating with the induction passage, and fuel supply means operable to supply fuel from a source of fuel to the secondary orifice, the fuel supply means including a valve apparatus, said valve apparatus including a wall defining a chamber having an axis and having therein an inlet and an outlet, one of the inlet and the outlet communicating with the chamber, and the other of the inlet and the outlet having a valve seat and being communicable with the chamber, a valve member having first and second opposite ends and having a variable length in the direction of the axis which decreases only when at least a predetermined force is applied to the valve member in the direction of the axis, and means for limiting movement of the second end towards the valve seat.

The invention also provides a valve apparatus comprising a wall defining a chamber having a longitudinal axis, a first end having an end wall, an open second end, the chamber also having an internally threaded portion located between the first end and the second end, the wall defining in the chamber an inwardly extending step located between the first end and the internally threaded portion, and the wall having therein an inlet communicating with the chamber and being located between the end wall and the step, and an outlet located on the end wall and including a valve seat communicable with the chamber, a needle portion extending along the axis and having a first end adapted to sealing engage the valve seat, and a second end, an adjusting rod extending along the axis and including first and second opposite ends, the first end having therein a recess slideably housing the second end of the needle portion such that a predetermined force is required to move the needle portion relative to the adjusting rod and along the longitudinal axis, the second opposite end including a threaded outer surface adapted to selectively engage the internally threaded portion of he chamber, the adjusting rod including means engageable with the step for limiting axial movement of the rod relative to the chamber.

A principal feature of the invention includes the provision of frictional sliding engagement between the needle portion and the adjusting rod. This allows proper seating of the valve member in the valve seat without application of excessive pressures to the valve seat or the valve member, thereby reducing waste due to breakage and the cost of precision manufacture of the valve assembly components. This also eliminates the need for setting precise gauge lengths of the valve member prior to assembly.

Another principal feature of the invention includes the provision of rotation of the valve member during adjustment and seating of the valve member with the valve seat, thereby providing proper mating of the valve seat and the valve member.

Another principal feature of the invention includes the provision of a larger surface to stop the advance of the adjusting rod during calibration of the needle valve, thereby allowing a surer method of calibration and setting of gauge length.

Another principal feature of the invention includes the provision of a plastic sleeve which is located in the adjusting rod and which holds the needle portion in place after the initial calibration of the needle valve. This allows for recalibration of the valve assembly without the necessity of resetting the gauge length of the valve member. Once the critical length of the valve member is set during the initial calibration, the length need not be set again, thus eliminating the risk of any excessive pressures being applied to the components of the needle valve during recalibration. The sleeve also provides damping of engine vibrations and provides for a seal against fluid backflow through the valve assembly.

Other features and advantages of the invention will become apparent to those skilled in the art upon review of the following detailed description, claims and drawings.

BRIEF DESCRIPTION OF THE DRAWINGS

FIG. 1 is a cross-sectional side view of a carburetor including a needle valve apparatus embodying various features of the invention and including a variable length valve member.

FIG. 2 is an enlarged cross-sectional view of the needle valve apparatus with a needle valve member seated and an adjusting rod not against a step.

FIG. 3 is an enlarged cross-sectional view of the needle valve apparatus with the valve member seated and the adjusting rod fully advanced against the step.

FIG. 4 is an enlarged cross-sectional view of the needle valve apparatus with the valve member unseated and the adjusting rod not against the step due to adjustment of the needle valve for calibration.

FIG. 5 is a further enlarged partial view of the adjusting rod fully advanced such that it engages the step.

Figure 6:
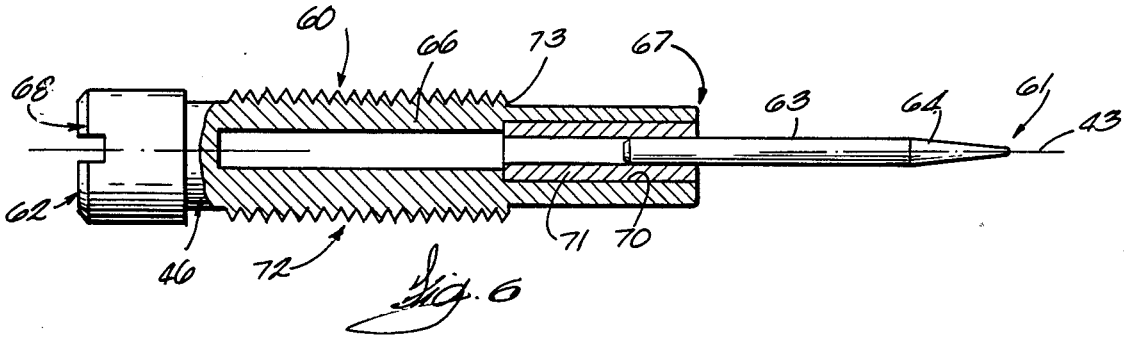
FIG. 6 is an enlarged side view of the valve member outside the chamber.

Before at least one embodiment of the invention is explained in detail, it is to be understood that the invention is not limited in its application to the details of construction in the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in the drawings is a fuel supply system 10 for an internal combustion engine (not shown). The fuel supply system 10 includes a carburetor 12.

In the preferred embodiment, the main body of the carburetor 12 is made of plastic. The carburetor 12 has a fuel/air induction passage 14 communicating with an engine fuel intake (not shown) and including a venturi 16 having a throat defining a low pressure zone 18. Mounted downstream of the venturi 16 is a throttle valve 20 which is movable between open and closed positions to control the flow of fuel and air through the fuel/air induction passage 14. Located in the wall of the fuel/air induction passage 14 adjacent to the periphery of the throttle valve 20 is one or more secondary orifices 22, each of which communicates with a fuel cavity or well 24 in the carburetor 12.

The carburetor 12 also includes fuel supply means operable to supply fuel from a source of fuel 25 to the fuel well 24. The fuel supply means includes a fuel duct or passage 26 through which fuel is supplied from the source of fuel 25 to the fuel well 24. The flow of fuel from the fuel passage 26 to the fuel well 24 is provided and controlled by a needle valve apparatus 27 described hereinafter.

The fuel supply means also includes a fuel chamber or float bowl 28. Fuel, such as gasoline or kerosene, is supplied to the float bowl 28 from the source of fuel 25 via an inlet hose or conduit 29 and a fuel pump 30 or other suitable means. The carburetor 12 includes a vent 31 through which the float bowl 28 is vented to the atmosphere.

Flow of the fuel to the float bowl 28 is controlled by a valve 32 which is connected to a float 33 and opens and closes in response to movement of the float 33. Thus, the valve 32 and float 33 serve to maintain a predetermined level of the fuel in the float bowl 28. Fuel is supplied from the float bowl 28 to the low pressure zone 18 through a fuel nozzle 34 extending between the float bowl 28 and the low pressure zone 18.

Fuel is supplied from the float bowl 28 to the fuel passage 26 by a pick-up conduit or tube 35 which extends between the float bowl 28 and the fuel passage 26. While other arrangements can be used, in the specific construction illustrated, the pick-up tube 3 is located inside the fuel nozzle 34 and an annular flow passage 36 is defined therebetween.

As the engine cranks, during starting of normal operations, a flow of fuel is induced from the float bowl 28 through the pick-up tube 35 and through the fuel passage 26 and the needle valve apparatus 27 into the fuel well 24. From the fuel well 24, the fuel flows through the secondary orifices 22 and into the fuel/air induction passage 14. At the same time a flow of fuel is induced from the float bowl 28 through the annular passage 36 and into the low pressure zone 18.

As shown in FIGS. 2–4, the valve apparatus 27 includes a wall 41 defining a valve chamber 42. The valve chamber 42 has a longitudinal axis 43, a first end 44 having an end wall 45, and an open second end 46, the first and second ends 44 and 46 being spaced along the longitudinal axis 43. The valve chamber 42 also has an internally threaded portion 47 located between the first end 44 of the chamber and the second end 46 of the chamber. The wall 41 also defines a step 48 (FIG. 5) located between the first end 44 of the chamber and the internally threaded portion 47. The reason for the step 48 is explained below.

The wall 41 has therein an inlet 49 and an outlet 50. The inlet 49 is located between the first end 44 of the valve chamber and the step 48 and communicates between the fuel passage 26 and the chamber 42. The outlet 50 (best shown in FIG. 4) is located in the end wall 45 and on the longitudinal axis 43. The outlet 50 includes a valve seat 51 and is communicable between the chamber 42 and the fuel well 24.

The needle valve apparatus 27 also includes a valve member 60 (FIG. 6) extending along the longitudinal axis 43 and having a variable length which decreases only when at least a predetermined force is applied to the valve member 60 in the direction of the axis 43. The valve member 60 has a first end 61 that is needle-shaped and is adapted to sealingly engage the valve seat 51, and an opposite second end 62. More particularly, the valve member 60 includes a first or needle portion 63. The needle portion 63 has opposite first and second or right and left ends. The right end of the needle portion 63 defines the first end 61 of the valve member. The valve member 60 also includes a second portion or adjusting rod 66 extending along the longitudinal axis 43 and having opposite right and left ends 67 and 68. The left end 68 of the adjusting rod 66 defines the second end 62 of the valve member 62. The first end 67 has therein a recess 70 adapted to slideably house the left end of the needle portion 63 such that a predetermined force is required to move the needle portion 63 relative to the adjusting rod 66 and along the longitudinal axis 43. More particularly, the adjusting rod 66 includes a plastic sleeve 71 which is located in the recess 70 and which slideably houses the valve member 60. The adjusting rod 66 includes, adjacent its left end 68, a threaded outer surface 72 adapted to threadedly engage the internally threaded portion 47 of the valve chamber 42.

The needle valve apparatus 27 also includes means for limiting movement of the valve member 60 toward the valve seat 51. While various suitable means can be employed, in the preferred embodiment, this means includes means for limiting axial movement of the adjusting rod 66 relative to the chamber 42. While various suitable limiting means can be employed, in the preferred embodiment, the means for limiting axial movement of the adjusting rod 66 relative to the chamber 42 includes the step 48 and also includes a a flat 73 located on the right end 67 of the adjusting rod 66 and adapted to engage the step 48.

The invention operates in the following way.

The needle valve apparatus 27 is first assembled outside of the valve chamber 42 (FIG. 6). The left end of the needle portion 63 is partially placed into the sleeve 71 in the right end of the adjusting rod 66 such that the right end of the needle portion 63 extends away from the adjusting rod 66. The needle portion 63 is placed into the sleeve 71 so that the overall valve member 60 is longer than the needle valve chamber 42. Other than ensuring that the valve member 60 is too long relative to the needle valve chamber 42, the assembler need not adjust the length of the valve member 60.

The valve member 60 is then threaded into the needle valve chamber 42. At a point illustrated in FIG. 2, the right end of the needle portion 63 contacts the valve seat 51. At this point the flat 73 has not yet made contact with the step 48. The adjusting rod 66 is advanced until the flat 73 does make contact with the step 48, as shown in FIG. 3. During the advance of the adjusting rod 66, the needle portion 63 rotates with respect to the valve seat 51. At the same time, the left end of the needle portion 63 is in frictional sliding engagement with the sleeve 71. This allows the valve member 60 to be reduced to its proper length at the point that the flat 73 engages the step 48 (FIG. 5).

Due to the frictional force between the needle portion 63 and the sleeve 71, advancement of the adjusting rod 66 causes the needle portion 63 to exert on the valve seat 51 a force equal to the frictional force.

Once the flat 73 engages the step 48, the adjusting rod 66 is fully advanced and pressure can no longer be applied to the valve seat 51.

As shown in FIG. 3, when the adjusting rod 66 is fully advanced, the valve member 60 is adjusted to the proper length. As shown in FIG. 4, the valve member 60 can then be backed off the valve seat 51 until the needle valve apparatus 27 is properly calibrated.

Various of the features of the invention are set forth in the following claims:

I claim:

1. A carburetor comprising a fuel/air induction passage, a secondary orifice communicating with said induction passage, and fuel supply means operable to supply fuel from a source of fuel to said secondary orifice, said fuel supply means including a valve apparatus, said valve apparatus including a wall defining a chamber having an axis and having therein an inlet and an outlet, one of said inlet and said outlet communicating with said chamber, and the other of said inlet and said outlet having a valve seat and being communicable with said chamber, a valve member having first and second opposite ends and having a variable length in the direction of said axis which decreases only when at least a predetermined force is applied to the valve member in the direction of said axis, and means for limiting movement of said second end towards said valve seat.

2. A valve apparatus in accordance with claim 1 wherein said chamber has a first end and a second end, and wherein said wall has thereon an inwardly extending step located between said first and second ends of said chamber, said valve member being engageable with said step.

3. A valve apparatus in accordance with claim 2 wherein said inlet is located between said end wall and said step.

4. A valve apparatus in accordance with claim 3 wherein said valve member includes a first portion, and a second portion including means for engaging said first portion.

5. A valve apparatus in accordance with claim 4 wherein said first portion has opposite ends, said first opposite end being adapted to sealingly engage said valve seat, and wherein said second portion engages said second end of said first valve member portion such that a length of said first portion extends from said second portion.

6. A valve apparatus in accordance with claim 5 wherein said engaging means includes a recess located in said second portion and housing said second end of said first portion.

7. A valve apparatus in accordance with claim 6 wherein said recess slideably houses said second end of said first portion.

8. A valve apparatus in accordance with claim 7 wherein said recess has therein a sleeve slideably housing said second end of said first portion.

9. A valve apparatus in accordance with claim 8 wherein said chamber includes an internally threaded portion, and wherein said second portion has a threaded outer surface adapted to engage said internally threaded portion of said chamber.

10. A valve apparatus in accordance with claim 9 wherein said internally threaded portion of said chamber is located between said second end of said chamber and said step.

11. A valve apparatus comprising a wall defining a chamber, the chamber having a longitudinal axis, a first end having an end wall, an open second end, the chamber also having an internally threaded portion located between said first end and said second end, said wall defining in said chamber an inwardly extending step located between said first end and said internally threaded portion, and said wall having therein an inlet communicating with said chamber and being located between said end wall and said step, and an outlet located on said end wall and including a valve seat communicable with said chamber, a needle portion extending along said axis and having a first end adapted to sealingly engage said valve seat, and a second end, and an adjusting rod extending along said axis and including first and second opposite ends, said first end having therein a recess slideably housing said second end of said needle portion such that a predetermined force is required to move said needle portion relative to said adjusting rod and along said longitudinal axis, said second opposite end including a threaded outer surface adapted to selectively engage said internally threaded portion of said chamber, and means engageable with said step for limiting axial movement of said rod relative to said chamber.

12. A valve apparatus in accordance with claim 11 wherein said adjusting rod includes a sleeve having therein said recess.

13. A valve apparatus in accordance with claim 11 wherein said sleeve is made of plastic.

* * * * *